United States Patent [19]

Mitcham

[11] Patent Number: 4,820,068

[45] Date of Patent: Apr. 11, 1989

[54] PRINTER HAVING RIBBON SHIFT MECHANISM

[75] Inventor: Larry D. Mitcham, Cypress, Tex.

[73] Assignee: Texas Instruments Incorporated, Dallas, Tex.

[21] Appl. No.: 39,840

[22] Filed: Apr. 20, 1987

Related U.S. Application Data

[63] Continuation of Ser. No. 794,039, Oct. 31, 1985, abandoned.

[51] Int. Cl.[4] ..... B41J 35/14

[52] U.S. Cl. ..... 400/216.1; 400/212; 400/240; 400/240.4; 400/248

[58] Field of Search ..... 400/208, 212, 216, 216.1, 400/217, 217.1, 240, 240.4, 247, 248, 323, 534, 615.2, 569

[56] References Cited

U.S. PATENT DOCUMENTS

| | | | |
|---|---|---|---|
| 3,426,356 | 2/1969 | Zolliker | 400/534 X |
| 3,618,738 | 11/1971 | Boyatt et al. | 400/569 X |
| 3,970,183 | 7/1976 | Robinson et al. | 400/323 X |
| 4,236,839 | 12/1980 | Mueller | 400/216.1 |
| 4,247,210 | 1/1981 | Kacmarcik et al. | 400/208 X |
| 4,543,002 | 9/1985 | Bittner et al. | 400/212 |
| 4,563,100 | 1/1986 | Hamamichi | 400/212 X |
| 4,568,209 | 2/1986 | Zerillo | 400/212 X |
| 4,632,583 | 12/1986 | Nash | 400/248 |
| 4,643,601 | 2/1987 | Nash et al. | 400/248 X |

FOREIGN PATENT DOCUMENTS

| | | | |
|---|---|---|---|
| 2508258 | 12/1982 | France | 400/240 A |
| 0016881 | 1/1983 | Japan | 400/212 |
| 0084788 | 5/1983 | Japan | 400/216.1 |
| 0078882 | 5/1984 | Japan | 400/216.1 |
| 0215888 | 12/1984 | Japan | 400/240.4 |

OTHER PUBLICATIONS

IBM Technical Disclosure Bulletin, "Color Ribbon Shift Mechanism", vol. 28, No. 9, Feb. 1986, pp. 3879–3880.

*Primary Examiner*—Ernest T. Wright, Jr.

*Attorney, Agent, or Firm*—Thomas G. Devine; James T. Comfort; Melvin Sharp

[57] ABSTRACT

An impact printer has a print ribbon that is divided into horizontal colored strips to enable color printing. A printhead is mounted on a moving carriage that moves across the width of a printing medium upon which the printing is to be deposited. The print ribbon also moves relative to the carriage. A ribbon shift mechanism is configured to include a print ribbon guide, the ribbon shift mechanism being slideably mounted in the carriage to move in a vertical direction relative thereto. A wire matrix printhead is connected to the carriage and has a printing end adjacent the print ribbon. A gear shaft is positioned to engage the gear sections of a pair of racks that are connected to the ribbon shift mechanism and which pass through the carriage. When the gear shaft is turned, the racks are engaged which cause the ribbon shift mechanism, and the print ribbon, to move either up or down thereby presenting a desired color to the printing end of the printhead. Printing is then performed in the desired color until a color change is required.

14 Claims, 4 Drawing Sheets

PRINTER HAVING RIBBON SHIFT MECHANISM

This application is a continuation of application Ser. No. 794,039, filed Oct. 31, 1985, now abandoned.

BACKGROUND OF THE INVENTION

1. Field of the Invention

This invention relates to web shifting in a vertical direction and more particularly to shifting a print ribbon divided into horizontal colored strips, in a printer, for applying the desired color to a print medium.

2. Description of the Prior Art

A common prior art system for shifting a colored ribbon is one where the entire ribbon cartridge is shifted. A stepping motor or solenoids shift the entire ribbon cartridge to a different level to print a different color strip. This technique entails moving a tremendous amount of mass requiring a large prime mover and also is limited in accuracy due to the great distance the controlling arms are from each other because no contact or vertical guidance occurs near the printhead itself. The problem of tolerance is generally solved with a wider band or some adjustment to compensate for errors.

The entire carriage shifter may also be equipped with a steel wire that runs across the printer to keep the print ribbon from sagging in wide printers. This technique allows the user of narrower band strips but still requires an adjustment screw to compensate for molding tolerances.

Another prior art mechanism is a solenoid mounted directly on the printhead with a guide mechanism to hold the ribbon close to the solenoid to accurately control shifting. This is more accurate than the previously described prior art mechanisms because it controls the ribbon very close to the printhead. It also allows the use of strips only slightly wider than the printhead swath. However, the speed of shifting is severely limited by the mass of the solenoid. Also, there is a high power consumption in moving quickly.

BRIEF SUMMARY OF THE INVENTION

In the preferred embodiment, this invention involves an impact printer having a print ribbon with colored horizontal strips to enable color printing. A printhead is mounted on a carriage that moves across the width of a printing medium on which the print is to be deposited. The print ribbon moves horizontally with respect to the printhead. A light weight ribbon shift mechanism engages the print ribbon in a ribbon guide and further is slideably engaged in the carriage. The ribbon shift mechanism has a pair of racks attached, the racks each having a gear section that passes through the carriage. A gear shift engages the rack gears so that when the shaft is rotated, the racks move either up or down. When the racks move, the ribbon shift mechanism also moves up and down, carrying the print ribbon with it to a predetermined position so that a particular color may be printed. The ribbon shift mechanism, the racks and the ribbon are the only components that are vertically moved in this invention making the movement very easy to accomplish when coupled with the low inertia gear shaft which is a spline type gear.

The principle object of this invention is to provide a color printer able to very rapidly shift from one color to another.

Another object of this invention is to provide a mechanism for moving a web in a vertical direction in a workstation.

These and other objects will be made evident in the detailed description that follows.

DETAILED DESCRIPTION

This invention permits the shifting of an endless web (print ribbon) in a vertical direction against a print medium for printing in color thereon in this preferred embodiment. The amount of inertia to overcome to perform this shifting has been minimized by using a very lightweight ribbon shift mechanism for vertical movement with the ribbon and lightweight racks engaging a relatively low inertia gear shaft all of which are described in detail below.

Figure 1:
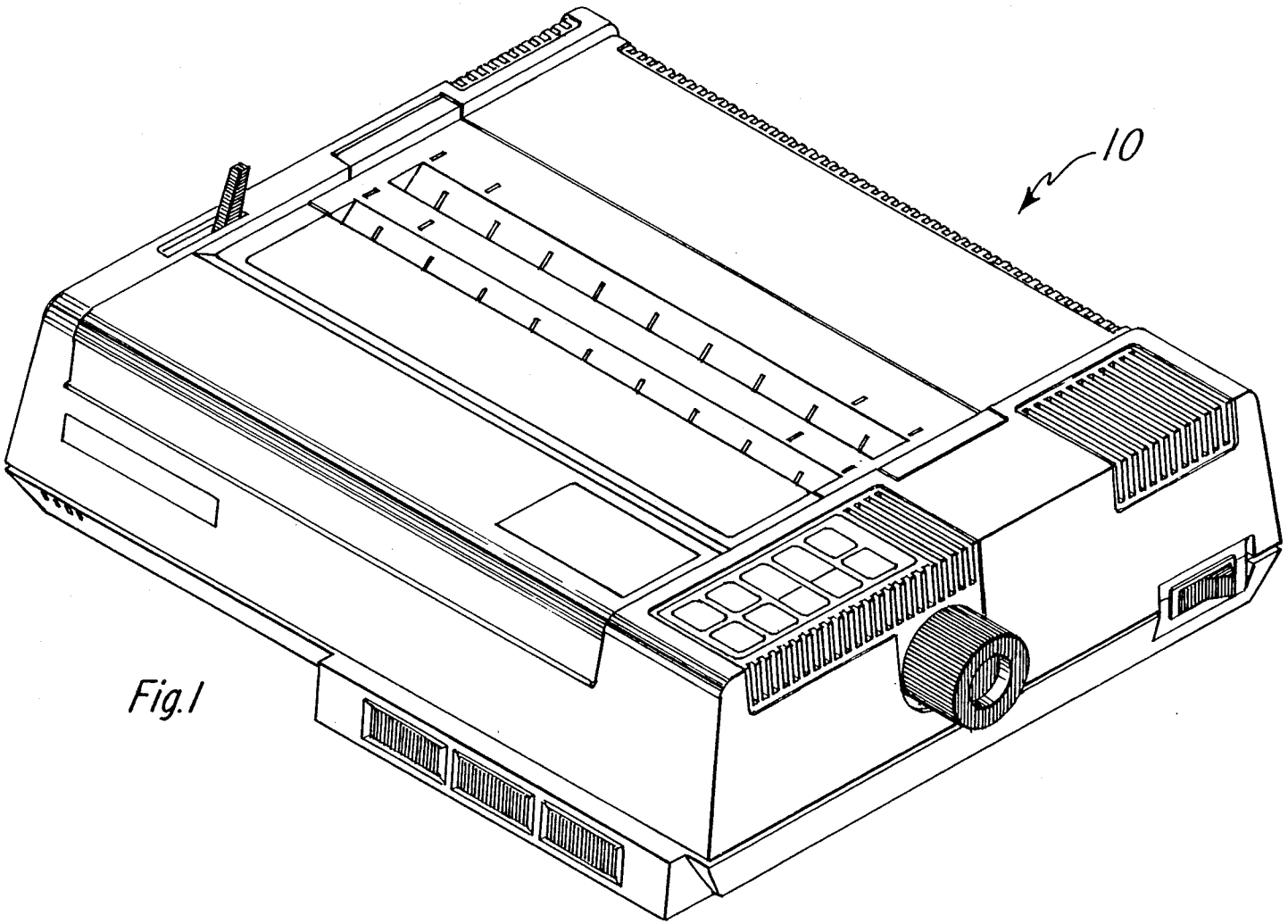
FIG. 1 is a perspective view of the printer in its preferred embodiment.

Referring now to FIG. 1, a perspective view of Texas Instruments printer type 857 is shown.

Figure 2:
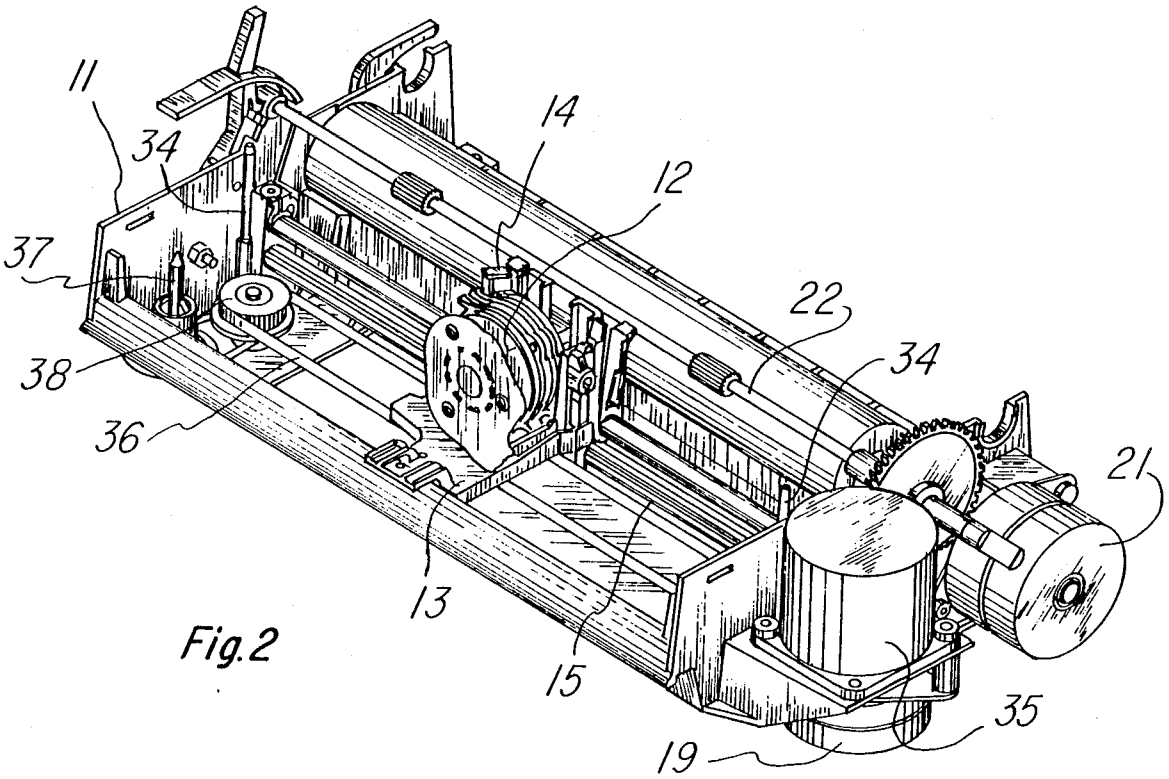
FIG. 2 is a perspective view of a portion of the interior of the printer of FIG. 1.

FIG. 2 illustrates frame 11, within the housing of printer 10, illustrating printhead 12 mounted on carriage 13 with ribbon shift mechanism 14 in position. The gear shaft 15 is also shown, driven by stepper motor 19. Motor 21 drives platen 22. Motor 35 drives belt 36, moving carriage 13. Ribbon drive 37 is O-ring coupled to pulley 38, which in turn, is driven by belt 36. Ribbon guide 34 is positioned to guide ribbon 20 in its path.

Figure 3:
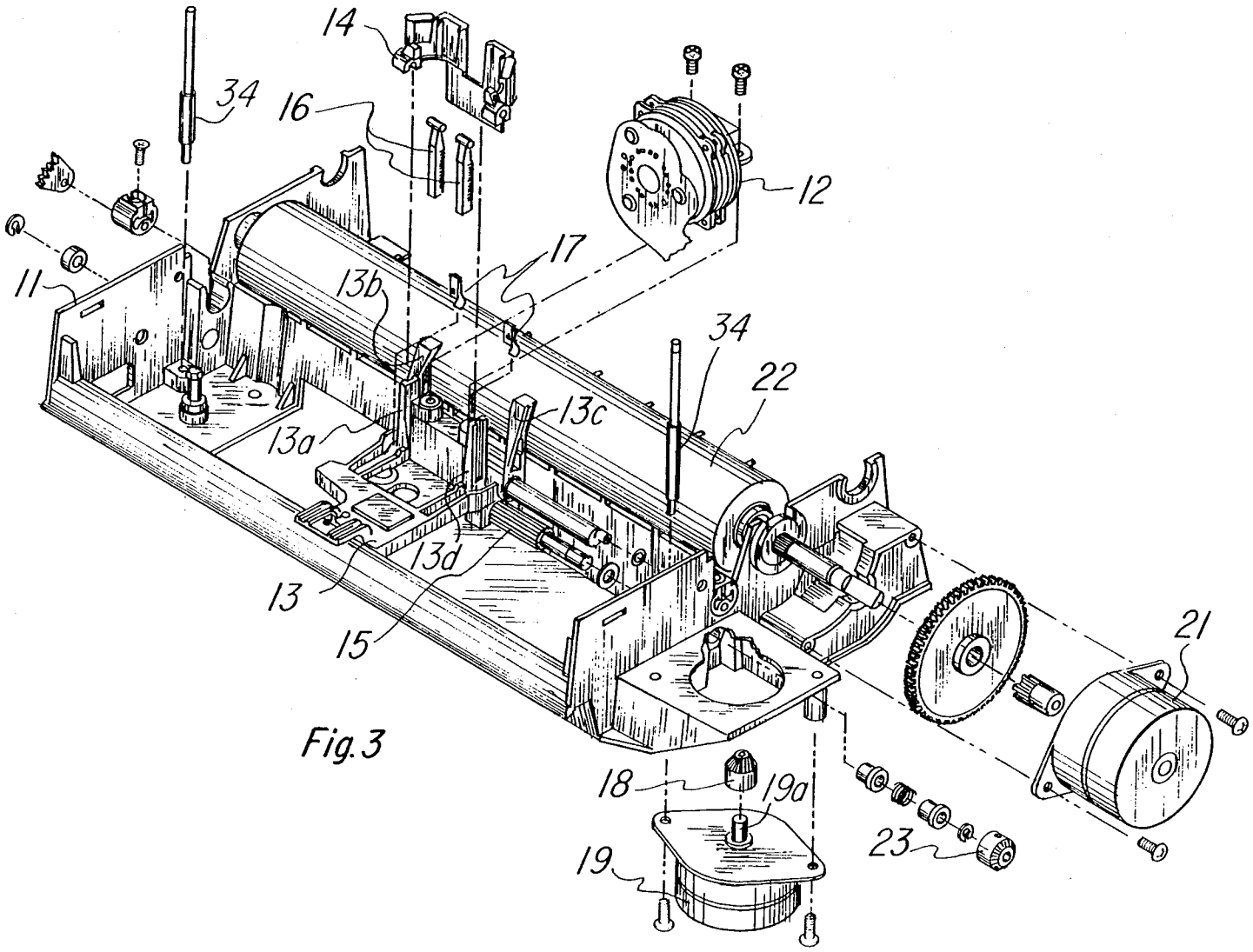
FIG. 3 is a perspective, exploded view of the assembly of FIG. 2.

FIG. 3 shows the components of FIG. 2 in exploded view so that ribbon shift mechanism 14 is clearly shown with racks 16 shown as positioned on shift mechanism 14. Printhead 12 is shown as it is positioned in carriage 13. Carriage 13 is also shown with the necessary configuration to receive ribbon shift mechanism 14 within the space formed by vertical arms 13*a*–13*d*. Gear shaft 15 is shown terminating in bevel gear 23 which engages bevel gear 18. Bevel gear 18 is connected to the shaft 19a of stepping motor 19 which drives spline gear shaft 15. In this preferred embodiment, the stepper motor selected is a Fuji type SM-55 with a 7½ degree step angle. This selection, is, of course, a designer's choice. Other stepping motors could be selected as well as other types of motive sources.

Figure 4:
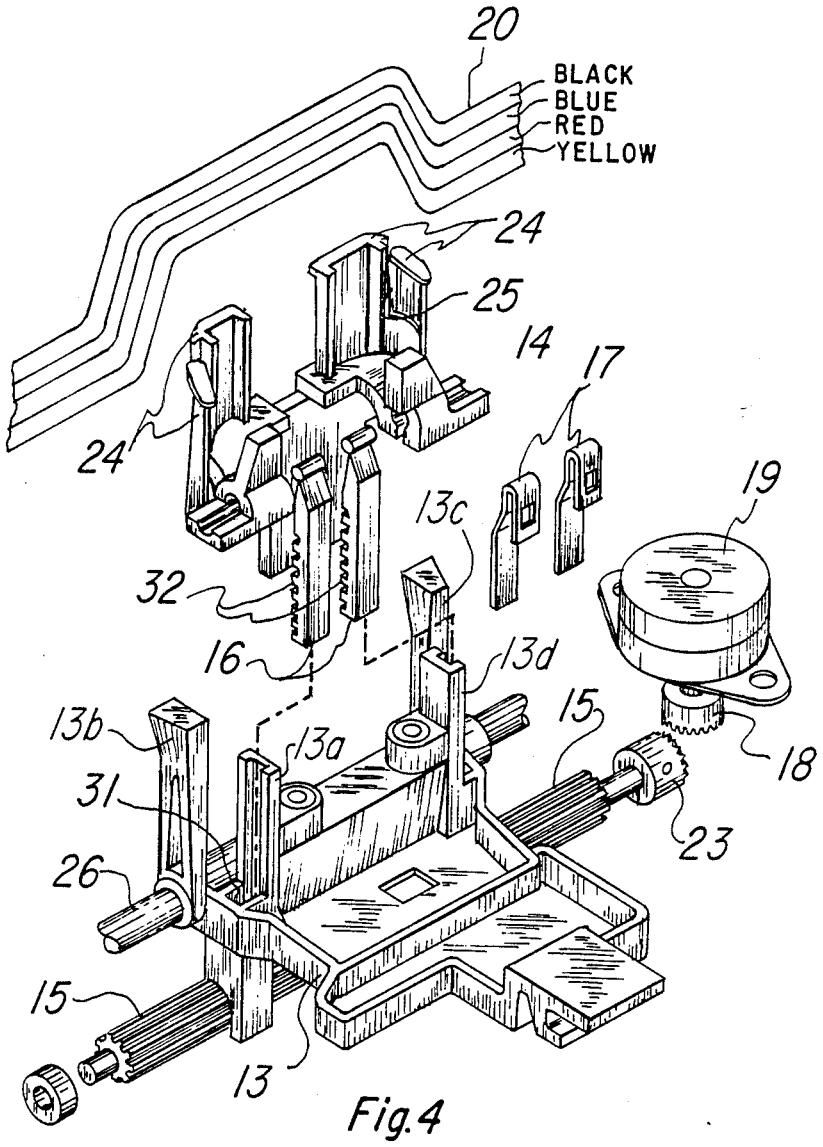
FIG. 4 is an exploded perspective view of the ribbon shifting apparatus of this invention.

FIG. 4 illustrates ribbon 20 having a black, a blue, a red and a yellow strip. These colors are by way of example only. Print ribbon 20 fits between projections 24 on ribbon shift mechanism 14, through slots 25.

Racks 16 are shown as they rotatably mount to ribbon shift mechanism 14. Racks 16 project through slots 31 in carriage 13. Springs 17 also fit into slots 31, positioned to urge the gears 32 into contact with spline gear shaft 15. Carriage 13 is shown as it is mounted slideably on carriage rod 26. Stepper motor 19 is shown as it drives bevel gear 18 which in turn engages bevel gear 23. Bevel gear 23 is connected to spline gear shaft 15 and turns in response to the activation of motor 19.

PREFERRED MODE OF OPERATION

Motor 19 of FIG. 4 responds to control signals that are manual or computer generated, to drive motor 19 in a direction and a distance suitable to position the appropriate color of ribbon 20 in line with the print end of printhead 12. When current is applied to stepper motor 19, bevel gear 18 turns, engaging bevel gear 23, which then turns gear shaft 15. Gear shaft 15 engages the gears 32 of racks 16, moving them up or down, depending on the direction of rotation of motor 19. If, for example, the movement is up, then racks 16 will move up, pushing up ribbon shift mechanism 14. Ribbon 20, within slots 25, moves up along with ribbon shift mechanism 14. The print medium (not shown) is directly behind ribbon 20 and receives the printing in the desired color. FIG. 4 illustrates the crux of this invention, namely the use of spline gear shaft 15 engaging light weight racks 16 which are connected to light weight ribbon shift mechanism 14. This combination reduces the inertia required to move the ribbon 20 in a vertical direction and increases the speed, so that, in this preferred embodiment, the shift is made in approximately 30 milliseconds.

Those skilled in the art may change materials and configuration without departing from the extent and scope of this invention which is limited only by the appended claims.

I claim:

1. A printer, including a frame, having a print ribbon for presentation at a printing position, comprising:

(a) ribbon shift means, configured to include a print ribbon guide;

(b) rack means, having a section of gear rack, attached to the ribbon shift means;

(c) carriage means configured to slideably receive the ribbon shift means and to engage the section of gear rack to pass at least partially through the carriage means;

(d) printhead means having a printing end, positioned to have the printing end adjacent the print ribbon for contacting the print ribbon when printing is desired;

(e) gear shaft means, rotatably mounted on the frame, positioned to engage the section of gear rack to cause the rack means to move vertically and in turn to cause the ribbon shift means and the print ribbon to move vertically in a desired direction for a predetermined distance to adjust the vertical position of the print ribbon relative to the printing end; and (f) motive means, mounted on the frame, connected to selectively rotate the gear shaft means in either direction.

2. The printer of claim 1 wherein the ribbon shift means comprises a plurality of projecting arms spaced apart to form the print ribbon guide.

3. The printer of claim 2 wherein the carriage means comprises vertical arms defining a space to slideably receive the ribbon shift means.

4. The printer of claim 3 wherein the ribbon is divided into a plurality of colored horizontal strips, and the motive means causes the gear shaft means to rotate sufficient to align a desired colored horizontal strip with the printing end.

5. The printer of claim 1 wherein the motive means comprises a stepping motor.

6. The printer of claim 4 wherein the motive means comprises a stepping motor.

7. An impact printer including a frame, employing a print ribbon, comprising:

(a) ribbon shift means, configured to include a print ribbon guide;

(b) rack means, having a section of gear rack, attached to the ribbon shift means;

(c) carriage means mounted to move horizontally, configured to slideably receive the ribbon shift means, and to engage the section of gear rack to pass at least partially through the carriage means;

(d) impact printhead means, connected to the carriage means, having a printing end adjacent the print ribbon for contacting the print ribbon when printing is desired;

(e) gear shaft means, rotatably mounted on the frame, positioned to engage the section of gear rack to cause the rack means to move vertically and in turn to cause the ribbon shift means and the print ribbon to move vertically for a predetermined distance to adjust the vertical position of the print ribbon relative to the printing end; and (f) motive means, mounted on the frame connected to selectively rotate the gear shaft means in either direction.

8. The printer of claim 7 wherein the ribbon shift means comprises a plurality of projecting arms spaced apart to form the print ribbon guide.

9. The printer of claim 8 wherein the carriage means comprises vertical arms defining a space to slideably receive the ribbon shift means.

10. The printer of claim 9 wherein the print ribbon is divided into a plurality of colored horizontal strips and the motive means causes the gear shaft means to rotate sufficient to align a desired colored horizontal strip with the printing end.

11. The printer of claim 10 wherein the printhead means comprises a stored energy, wire matrix printhead.

12. The printer of claim 7 wherein the motive means comprises a stepping motor.

13. The printer of claim 11 wherein the motive means comprises a stepping motor.

14. Web handling apparatus, including a frame, for moving a web past a workstation, comprising:

(a) web shift means, positioned at the work station, configured to include a web guide for receiving the web;

(b) rack means, having a section of gear rack, attached to the web shift means;

(c) carriage means, configured to slideably receive the web shift means and to pass the gear rack through the carriage means;

(d) gear shaft means, rotatably mounted on the frame positioned to engage the section of gear rack to cause the rack means to move vertically and in turn to cause the web shift means and the web to move vertically a predetermined distance to adjust the vertical position of the web; and (e) motive means, mounted on the frame, connected to selectively rotate the gear shaft means in either direction.

* * * * *